US008063837B1

(12) United States Patent
Jennings et al.

(10) Patent No.: US 8,063,837 B1
(45) Date of Patent: Nov. 22, 2011

(54) SYSTEM FOR PROVIDING A PRESSURE VESSEL, RADOME, RF SUB-SYSTEM BOX AND ELECTRICALLY SMALL, WIDEBAND OMNI AND/OR ADAPTABLE BEAM ANTENNA

(75) Inventors: William C. Jennings, Iowa City, IA (US); James B. West, Cedar Rapids, IA (US); John Mather, Cedar Rapids, IA (US); Ross K. Wilcoxon, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 665 days.

(21) Appl. No.: 12/284,558

(22) Filed: Sep. 23, 2008

(51) Int. Cl.
*H01Q 1/28* (2006.01)

(52) U.S. Cl. ..... 343/705; 343/708

(58) Field of Classification Search ..... 343/705
See application file for complete search history.

(56) References Cited

U.S. PATENT DOCUMENTS

| | | | | |
|---|---|---|---|---|
| 6,198,445 | B1 * | 3/2001 | Alt et al. | 343/705 |
| 6,919,846 | B2 * | 7/2005 | Koch et al. | 343/705 |
| 7,642,975 | B2 * | 1/2010 | Brunks et al. | 343/705 |
| 2005/0200526 | A1 * | 9/2005 | Crain et al. | 343/700 MS |

* cited by examiner

*Primary Examiner* — Trinh Dinh
(74) *Attorney, Agent, or Firm* — Daniel M. Barbieri

(57) ABSTRACT

The present invention is a system which includes an interposer. The interposer may include a mounting plate for mounting the interposer to a fuselage of an aircraft. The interposer may interface with the fuselage to form a seal for maintaining pressure within the aircraft. The system may further include an antenna module. The antenna module may include a ground plane, an aircraft antenna, and a radome. The ground plane may be connected to the aircraft antenna and may be configured for allowing the antenna module to be mounted to the interposer. The radome may be connected to the ground plane to form an enclosure for housing the antenna. The antenna module may be removably connected to the interposer. The system may further include an interconnect for electrically connecting the antenna module to electronics located within the aircraft. The antenna module may be disconnected from the interposer without breaking the seal formed between the interposer and the fuselage.

20 Claims, 2 Drawing Sheets

SYSTEM FOR PROVIDING A PRESSURE VESSEL, RADOME, RF SUB-SYSTEM BOX AND ELECTRICALLY SMALL, WIDEBAND OMNI AND/OR ADAPTABLE BEAM ANTENNA

FIELD OF THE INVENTION

The present invention relates to the field of Radio Frequency (RF) devices and Advanced Radio Systems and particularly to a system for providing Global Positioning System (GPS) capability, a pressure vessel enclosure, a radome and an Radio Frequency (RF) sub-systems enclosure for integration with an antenna, such as an electrically small, wideband omni and/or steerable beam and/or adaptable beam antenna as disclosed in the U.S. patent application entitled: A System and Method for Providing an Electrically Small, 900 Megahertz (MHz) to 10 Gigahertz (GHz) Ultra-Wideband, Omni-Directional and TCAS or CISS Steerable Directional Antenna with GPS or XM Circularly Polarized Antenna filed Aug. 14, 2008 and having Express Mail Mailing Label Number EM 210498603 US, which is hereby incorporated by reference.

BACKGROUND OF THE INVENTION

A number of current RF devices (ex. —antennas/antenna modules/antenna systems) for aircraft may have structural characteristics which make them cost-inefficient and less than desirable for implementation with the aircraft.

Thus, it would be desirable to provide a system for providing an antenna which obviates the problems associated with current antennas.

SUMMARY OF THE INVENTION

Accordingly, an embodiment of the present invention is directed to a system, including: an interposer, the interposer configured for being mounted to a fuselage of an aircraft, the interposer configured for interfacing with the fuselage to form a seal for maintaining pressure within the aircraft; and an antenna module, the antenna module configured for being mounted to the interposer, wherein the antenna module is removably connected to the interposer.

An additional embodiment of the present invention is directed to a system, including: an interposer, the interposer including a mounting plate for allowing the interposer to be mounted to a fuselage of an aircraft, the interposer configured for interfacing with the fuselage to form a seal for maintaining pressure within the aircraft; and an antenna module, the antenna module including a ground plane, an aircraft antenna, and a radome, the ground plane configured for allowing the antenna module to be mounted to the interposer, the aircraft antenna configured for being connected to the ground plane, the radome configured for being connected to the ground plane, thereby forming an enclosure for housing the antenna, wherein the antenna module is removably connected to the interposer.

A further embodiment of the present invention is directed to a system, including: an interposer, the interposer including a mounting plate for allowing the interposer to be mounted to a fuselage of an aircraft, the interposer configured for interfacing with the fuselage to form a seal for maintaining pressure within the aircraft; an antenna module, the antenna module including a ground plane, an aircraft antenna, and a radome, the ground plane configured for allowing the antenna module to be mounted to the interposer, the aircraft antenna configured for being connected to the ground plane, the radome configured for being connected to the ground plane, thereby forming an enclosure for housing the antenna, wherein the antenna module is removably connected to the interposer; and an interconnect for electrically connecting the antenna module to electronics, said electronics being located within the aircraft, wherein the antenna module is configured for being disconnected from the interposer without breaking the seal formed between the interposer and the fuselage.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Aircraft antennae may be directly attached/connected to an outer/exterior surface of the aircraft/aircraft fuselage. Further, said aircraft antennae may be connected to electronics located in the interior of/within the aircraft. For example, the aircraft antennae may be electrically connected to the electronics via cables which pass through/are fed through holes formed in the aircraft fuselage. When an antenna is removed from the aircraft, an outside pressure seal may be violated, which may require that pressure vessel integrity be re-established/re-certified. This may be problematic in that the process of re-establishing/re-certifying the integrity of the pressure vessel may be time-consuming and expensive. Consequently, even minor damage incurred by an aircraft antenna, such as during maintenance of the aircraft, may result in significant cost/time spent since the above-referenced process of re-establishing/re-certifying the integrity of the pressure vessel may have to be performed.

Because of the above-referenced factors, it may be desirable that aircraft antennae have extremely high mean time between failures so as to minimize the need for/frequency of maintenance. Therefore, active electronics (which often are much less reliable/have much lower reliability than passive electronics) may not typically be integrated with/implemented with said aircraft antennae. The system of the present invention allows for quick replacement of aircraft antennae without having to violate the pressure vessel, thereby promoting reduced maintenance time/costs associated with repairing/replacing either purely passive antennae/antenna modules or antennae/antenna modules which include both passive and active components.

Figure 1:
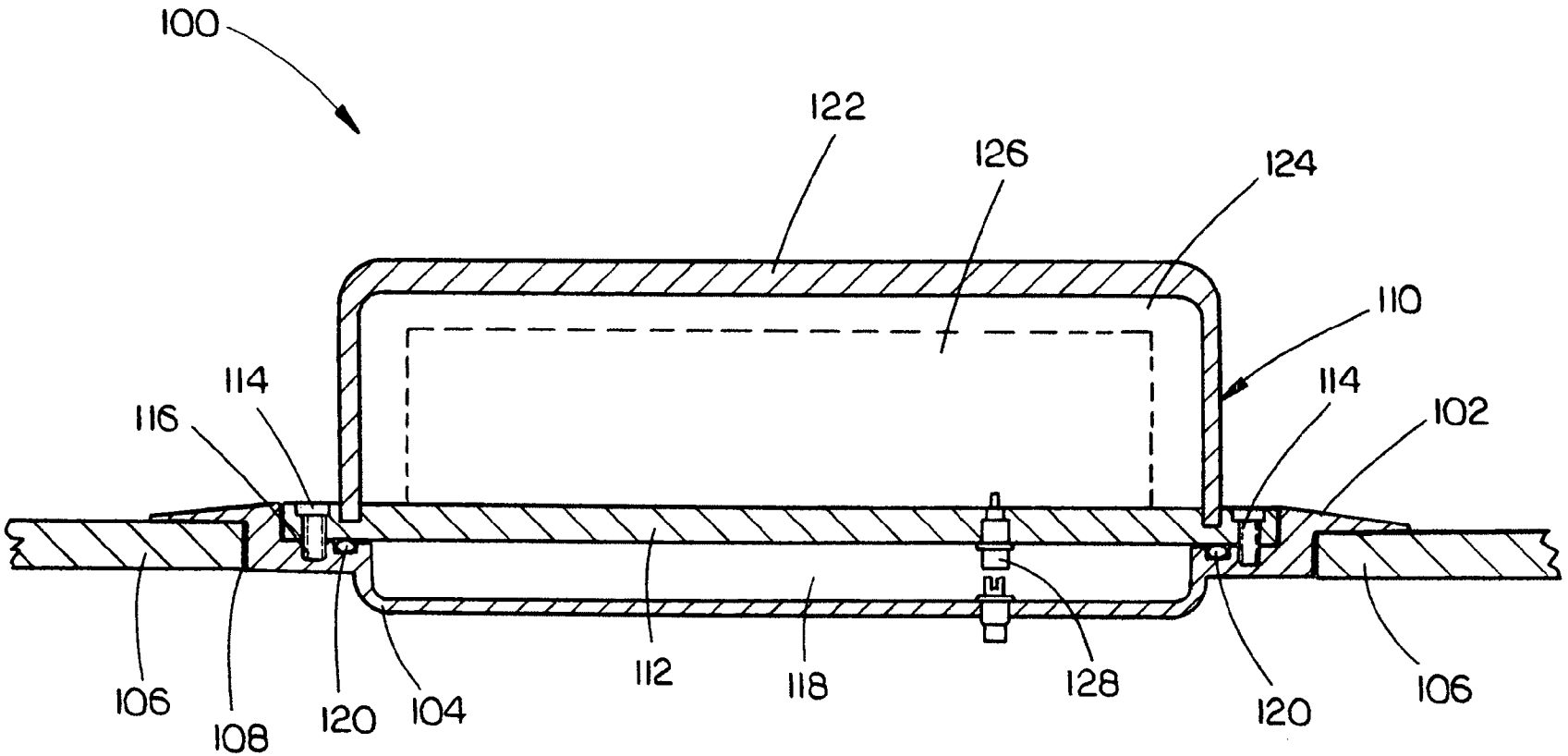
FIG. 1 is a cross-sectional view of a system (ex. —antenna assembly) in accordance with an exemplary embodiment of the present invention.
Figure 2:
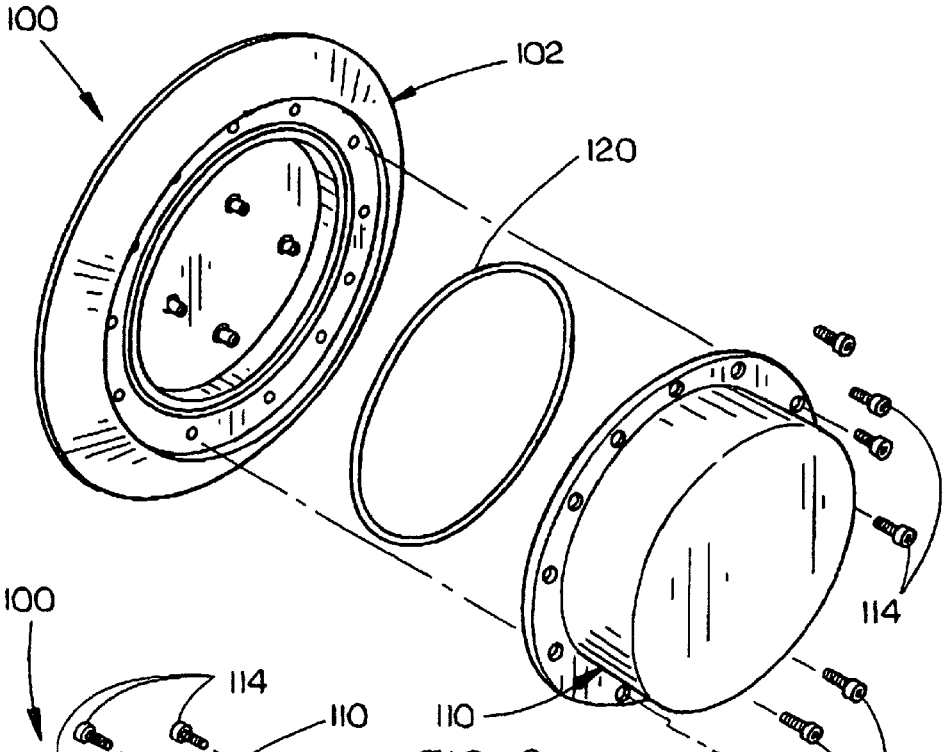
FIG. 2 is a first exploded view of the system shown in FIG. 1 in accordance with an exemplary embodiment of the present invention.
Figure 3:
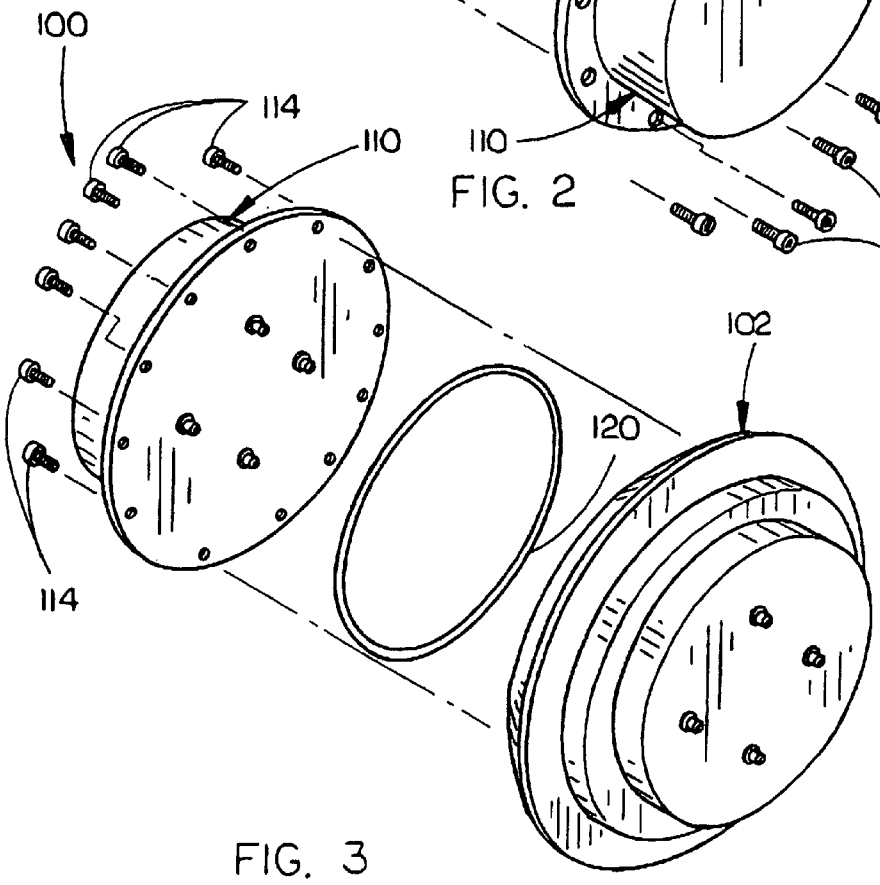
FIG. 3 is a second exploded view of the system shown in FIG. 1 in accordance with an exemplary embodiment of the present invention.

Referring generally to FIGS. 1-3, a system (ex. —antenna assembly) in accordance with an exemplary embodiment of the present invention is shown. The system 100 may include an interposer 102. In current embodiments of the present invention, the interposer 102 may be/may include a mounting plate 104. The mounting plate 104 of the interposer 102 may be configured for allowing the interposer 102 to be mounted to a fuselage/exterior surface/skin 106 of an aircraft. For example, the interposer 102 may either penetrate the fuselage 106 via a hole formed within/by the fuselage 106, or, alternatively, the interposer 102 may be entirely surface mounted on the fuselage 106. In the illustrated embodiment, the mounting plate 104 of the interposer 102 may be a pressure-tight mounting plate 104 which is configured for interfacing with the fuselage 106 (ex. —via the interposer-to-aircraft interface 108) to form a seal (ex. —an aircraft pressure seal) for maintaining pressure within the aircraft. The interposer 102 may be semi-permanently attached to the aircraft fuselage 106 (ex. —the seal may be a semi-permanent seal), such that, if the interposer 102 is removed from the aircraft fuselage 106, any subsequently-established pressure seal may require certification via a pressure test. In further embodiments, the seal formed between the interposer 102 and the aircraft fuselage 106 may be established via any one of a number of conventionally-implemented sealing methods which are currently utilized/currently available for attaching aircraft antennae to aircrafts/aircraft fuselages.

In exemplary embodiments of the present invention, the system 100 may further include an antenna module/antenna pod 110. The antenna module 110 may be configured for being mounted to/connected to/attached to the interposer 102. In further embodiments, the antenna module 110 may include a ground plane 112. The ground plane 112 of the antenna module 110 may be configured for being mounted to/attached to/connected to the interposer 102. For example, the ground plane 112 of the antenna module 110 may be removably connectable to the interposer 102 via fasteners 114 as shown in FIG. 1. In additional embodiments, the ground plane 112 may be a weather-tight ground plane 112, such that the ground plane 112 may be connected to/may interface with the interposer 102 in such a manner as to form an antenna module-to-interposer interface 116 which is a weather-tight interface/weather-tight seal 116. The weather-tight interface 116 formed by the ground plane 112 and interposer 102 may further provide a weather-sealed enclosure/weather-tight enclosure 118. The weather-tight enclosure/protective enclosure 118 may promote protection of electronic components/electrical wiring of the system 100 from exposure to the elements. As shown in the illustrated embodiment, an o-ring 120, for example, may be implemented/established between the interposer 102 and the ground plane 112 to facilitate formation of the weather-tight, antenna module-to-interposer interface 116 and the sealed enclosure 118 formed via said interface 116.

In additional embodiments of the present invention, the antenna module 110 may include a radome 122. The radome 122 may be configured for being connected to the ground plane 112, thereby forming an enclosure 124 for housing one or more aircraft antennae 126. In the illustrated embodiment, the radome 122 is shown as having a top-hat cross-section/top-hat configuration, however, the radome 122 of the present invention may be various configurations/shapes, such that the configuration/shape of the radome 122 which is implemented may be tailored to specific aerodynamic requirements of the particular aircraft with which said radome 122 is implemented.

As mentioned above, the antenna module 110 may include/may be configured for housing one or more aircraft antennae 126. For example, the aircraft antennae 126 may be an electrically small, wideband omni and/or steerable beam and/or adaptable-beam antennae as disclosed in the U.S. patent application entitled: A System and Method for Providing an Electrically Small, 900 Megahertz (MHz) to 10 Gigahertz (GHz) Ultra-Wideband, Omni-Directional and TCAS or CISS Steerable Directional Antenna with GPS or XM Circularly Polarized Antenna filed Aug. 14, 2008 and having Express Mail Mailing Label Number EM 210498603 US, which is hereby incorporated by reference. Further, the aircraft antenna(s) 126 may be any one or more of the various antenna embodiments disclosed in the U.S. patent application entitled: A System and Method for Providing an Electrically Small, 900 Megahertz (MHz) to 10 Gigahertz (GHz) Ultra-Wideband, Omni-Directional and TCAS or CISS Steerable Directional Antenna with GPS or XM Circularly Polarized Antenna filed Aug. 14, 2008 and having Express Mail Mailing Label Number EM 210498603 US, which is hereby incorporated by reference. Still further, the antennae 126 implementable in/with the system 100 of the present invention may be any one or more of a number of other embodiments of currently available, generally applicable antennae. Additionally, the antennae 126 implementable in/with the system of the present invention may be a circularly-polarized Global Positioning Systems (GPS) antenna.

In exemplary embodiments, the aircraft antenna(s)/antennae 126 may be at least partially enclosed within/integrated with/included as part of the antenna module 110. Further, supporting electronics (ex. —RF sub-systems electronics) for the aircraft antenna/antennae 126 may be at least partially enclosed within/integrated with/included as part of the antenna module/antenna pod 110 or within the interposer 102, or within the weather-tight enclosure/protective enclosure/interposer volume 118, and/or within the interposer 102. In current embodiments of the present invention, the antenna/antennae 126 may be connected to the ground plane 112 of the antenna module 110. Further, the antenna module 110 (including the antenna/antennae 126) may be removably connected to the interposer 102 via the ground plane 112, such that the antenna module-to-interposer interface/weather-tight interface/weather-tight seal 116 is/forms a removable seal 116.

In additional embodiments, the system 100 may include an interconnect/connector 128 for electrically connecting the antenna module 110 (including electrically connecting the antenna/antennae 126, the ground plane 112 and the supporting electronics) to electronics, such as electronics which are located within the interior of the aircraft. For example, the interconnect 128 may be implemented in the interposer 102 and/or ground plane 112 and may be a bulkhead connector(s), a blind mate connector/blind mate connector pair(s) (ex. —a blind mate coax connector/connector pair(s)), any of a number of various RF interconnects, a digital signal interconnect, an electro-optic signal interconnect, a power signal interconnect, and a control signal interconnect. Further, the interconnect 128 may include one or more cables having appropriate service loops for connecting the antenna module 110 and the electronics located within the aircraft/in the interior of the aircraft. Still further, the interconnect 128 may be a hybrid connector(s), each hybrid connector including coax, power and signal contacts. Still further, the interconnect 128 may be a hermetic interconnect/may include hermetic connectors.

In exemplary embodiments of the present invention, the interposer 102 and the antenna module 110 may be configured/constructed to mechanically and electrically interface with each other in a standardized manner. For instance, the interposer 102 may be constructed in such a manner as to be mechanically and electrically connectable to various configurations of the antenna module 110 of the present invention and to various other antenna modules. Further, the interposer 102 and/or the antenna module 110 may be constructed to mechanically and electrically interface with any one or more of a number of various aircraft fuselages/aircraft fuselage designs/aircrafts, such that neither said aircraft(s), nor the wiring harnesses of said aircraft(s) require modification.

As mentioned above, the antenna module 110 is removably connected to the interposer 102. In current embodiments of the present invention, the antenna module 110 may be disconnected (ex. —mechanically and electrically) from the interposer 102 without disrupting/violating/breaking the aircraft pressure seal formed via the interposer-to-aircraft interface/the interposer-aircraft connection 108. This aspect of the present invention is advantageous in that the antenna module 110 (which may include multiple antennae 126) may be removed/disconnected from the interposer (and thus, disconnected from the aircraft fuselage 106) such as during maintenance and/or when the antenna module 110 needs to be replaced without violating/breaking the aircraft pressure seal formed/maintained by the interposer-to-aircraft interface 108, thereby avoiding the costly and time-consuming process of having to re-establish and re-certify the aircraft pressure seal/the aircraft pressure vessel integrity. In additional embodiments, because of the fact that the antenna module 110 of the system 100 of the present invention may be removed without violating the aircraft pressure seal, the electronics included within/integrated within the antenna module 110 may be/may include active electronics (ex. —instead of/in addition to passive electronics), despite the fact that active electronics may have a much lower mean time between failures than conventional passive electronics/passive antennas. Active electronics may also be included within the weather-tight enclosure/protective enclosure/interposer volume 118, and/or within the interposer 102

In exemplary embodiments, the weather-tight interface/antenna module-to-interposer interface/weather-tight seal 116 formed between the antenna module 110 and the interposer 102 may be established in a manner similar to any one of a number of conventionally-implemented sealing methods which are currently utilized/currently available for attaching aircraft antennae to aircrafts/aircraft fuselages. However, the antenna module-interposer seal 116 of the present invention would preferably be formed to promote ease of frequent removal of the antenna module 110 and to further promote connection/disconnection of various types of antenna modules 110/antenna configurations.

In further embodiments of the present invention, since the interposer 102 does not act as a radome, (ex. —since the interposer 102 does not need to be relatively transparent to RF energy) the interposer 102 may be fabricated from a wider range of potential materials than can a cover/radome of a conventional antenna. In exemplary embodiments of the present invention, the interposer 102 may be fabricated of materials in the same family as those materials which form the aircraft fuselage 106, thereby minimizing the risks of corrosion and thermal mismatch.

In additional embodiments, the form factor of the antenna module 110 and interposer 102 may be dictated to a large extent by antenna geometry requirements and the sizes of any electronics, connectors, etc. implemented in the interposer 102 or module 110.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A system, comprising:

an interposer, the interposer configured for being mounted to a fuselage of an aircraft, the interposer configured for interfacing with the fuselage to form a seal for maintaining pressure within the aircraft; and an antenna module, the antenna module configured for being mounted to the interposer, wherein the antenna module is removably connected to the interposer.

2. A system as claimed in claim 1, wherein the interposer includes a mounting plate.

3. A system as claimed in claim 1, wherein the antenna module includes an aircraft antenna, a radome, and a ground plane.

4. A system as claimed in claim 1, further comprising:

an interconnect for electrically connecting the antenna module to electronics, said electronics being located within the aircraft.

5. A system as claimed in claim 4, wherein the interconnect includes a hermetic blindmate coax connector pair.

6. A system as claimed in claim 4, wherein the interconnect includes a hybrid connector, said hybrid connector having coax, power and signal contacts.

7. A system as claimed in claim 1, wherein the antenna module is configured for being disconnected from the interposer without violating the seal formed by the interfacing of the interposer and the fuselage.

8. A system, comprising:

an interposer, the interposer including a mounting plate for allowing the interposer to be mounted to a fuselage of an aircraft, the interposer configured for interfacing with the fuselage to form a seal for maintaining pressure within the aircraft; and an antenna module, the antenna module including a ground plane, an aircraft antenna, and a radome, the ground plane configured for allowing the antenna module to be mounted to the interposer, the aircraft antenna configured for being connected to the ground plane, the radome configured for being connected to the ground plane, thereby forming an enclosure for housing the antenna, wherein the antenna module is removably connected to the interposer.

9. A system as claimed in claim 8, further comprising:

an interconnect for electrically connecting the antenna module to electronics, said electronics being located within the aircraft.

10. A system as claimed in claim 9, wherein the interconnect includes a blindmate coax connector pair.

11. A system as claimed in claim 9, wherein the interconnect includes a hybrid connector, said hybrid connector having coax, power and signal contacts.

12. A system as claimed in claim 8, wherein the antenna module is configured for being disconnected from the interposer without violating the seal formed between the interposer and the fuselage.

13. A system as claimed in claim 8, wherein the antenna has a bandwidth of 0.95 Gigahertz (GHz) to 10.0 Gigahertz (GHz).

14. A system as claimed in claim 8, wherein the antenna is a circularly polarized Global Positioning Systems (GPS) antenna.

15. A system as claimed in claim 8, wherein the antenna is a steerable beam antenna.

16. A system as claimed in claim 8, wherein the antenna is an adaptable beam antenna.

17. A system, comprising:

an interposer, the interposer including a mounting plate for allowing the interposer to be mounted to a fuselage of an aircraft, the interposer configured for interfacing with the fuselage to form a seal for maintaining pressure within the aircraft;

an antenna module, the antenna module including a ground plane, an aircraft antenna, and a radome, the ground plane configured for allowing the antenna module to be mounted to the interposer, the aircraft antenna configured for being connected to the ground plane, the radome configured for being connected to the ground plane, thereby forming an enclosure for housing the antenna, wherein the antenna module is removably connected to the interposer; and an interconnect for electrically connecting the antenna module to electronics, said electronics being located within the aircraft, wherein the antenna module is configured for being disconnected from the interposer without breaking the seal formed between the interposer and the fuselage.

18. A system as claimed in claim 17, wherein the interconnect is at least one of: a Radio Frequency (RF) interconnect, a digital signal interconnect, an electro-optic signal interconnect, a power signal interconnect, and a control signal interconnect.

19. A system as claimed in claim 17, wherein the antenna module further includes active electronics.

20. A system as claimed in claim 17, wherein the ground plane is configured for being connected to the interposer to form a protective enclosure.

* * * * *